United States Patent [19]

Tiedemann

[11] Patent Number: 4,530,165

[45] Date of Patent: Jul. 23, 1985

[54] DRYING OF SOLVENT-TREATED OBJECTS

[75] Inventor: Wolfgang O. Tiedemann, Sigtuna, Sweden

[73] Assignee: Vico Kemisk Tekniska Fabrik AB, Bandhagen, Sweden

[21] Appl. No.: 799,787

[22] Filed: May 23, 1977

[30] Foreign Application Priority Data

May 21, 1976 [SE] Sweden ..... 7605824

[51] Int. Cl.[3] ..... B43L 13/00

[52] U.S. Cl. ..... 34/32; 34/77; 34/80; 34/212; 34/224; 34/232

[58] Field of Search ..... 34/32, 77, 15, 212, 34/224, 232, 80

[56] References Cited

U.S. PATENT DOCUMENTS 1,328,897 1/1920 Rice ..... 34/32
3,798,787 3/1974 Heen ..... 34/77
3,908,285 9/1975 Ryan et al. ..... 34/77
4,185,397 1/1980 Hutzenlaub ..... 34/77

*Primary Examiner*—Josephine L. Barr
*Attorney, Agent, or Firm*—Burns, Doane, Swecker and Mathis

[57] ABSTRACT

Solvent-treated objects are dried in a drying chamber having a drying zone and at least one transfer zone for introducing into and/or removal from the drying zone of the object. The drying zone is created by recirculating drying air at high air flow rate by selectively sucking air from and blowing air into the drying zone and by removing recirculated solvent-carrying air from the drying zone by suction to provide a negative pressure in the drying chamber with greatest negative pressure in the drying chamber in the drying zone. Removed drying air is preferably passed through a solvent recovery carbon filter.

26 Claims, 2 Drawing Figures

DRYING OF SOLVENT-TREATED OBJECTS

The present invention relates to drying of solvent-treated objects. The invention is more closely connected to a method and an apparatus for such drying by means of recirculated drying air, which is led off after entraining the solvent, preferably to a solvent recovery device. The invention is particularly suited to drying objects which have been treated with organic solvents, e.g. metal objects degreased by means of chlorated hydrocarbons, and wooden objects impregnated with impregnating agents.

In the prior art, solvent-treated objects have most often been dried by causing the solvent to be absorbed by a passing stream of air, which is thereafter vented to the atmosphere. In order that drying shall take place at a reasonable rate, it is required that the passing amount of air is large and has a relatively large velocity. The concentration of absorbed solvent in the departing air will thereby be low, i.e. the saturation limit for the solvent in the air is many times greater than this concentration. This method therefore involves a great waste of air. The air used is normally taken from the room where drying is carried out, and therefore very large quantities of warmed or conditioned fresh air must be supplied, which required much energy. A method of this kind is moreover not advantageous insofar as there is no control over the solvent concentration in the room in question since the solvent leaks out into the room and because valuable solvent is passed out into the atmosphere. An attempt to get rid of the latter disadvantage has been made by passing the vented-off air through a solvent recovery device, e.g. a carbon filter, but because of the low solvent content in the vented-off air, such a device must have dimensions which are so large that its utilization is both expensive and space consuming.

It has also been proposed earlier to dry solvent-treated objects, especially enamelled objects, in an enclosable drying chamber wherein drying air is recirculated by means of an outside circulation duct containing a recovery device for the solvent. Even this device has the disadvantage of low solvent content in the drying air and defective control over solvent leakage into the room.

It has further been proposed to dry objects, treated with solvent in the process of enamelling by putting them in an enclosable drying chamber in which drying air is recirculated by means of an outside recirculating duct for increasing the solvent content in the drying air, a portion of the recirculated drying air being taken from the recirculating duct and possibly taken to a device for recovering the solvent. The object of this kind of recirculation has been to ensure drying in an atmosphere with a controlled solvent content so that the enamelled surface of the objects will be the best possible. Even if the ability of the drying air to entrain solvent is better utilized per se in this case, this method does not constitute any solution to the problem of providing highly effective drying with low energy consumption and complete elimination of solvent discharge into the room in which drying takes place.

The object of the present invention is therefore to provide a method and an apparatus for drying of the kind set forth in the introduction, whereby the last-mentioned problems are solved and the other disadvantages mentioned hereinbefore are avoided, while further advantages are gained.

These objects and others are achieved by the present invention by a method and apparatus of drying objects treated with solvent, essentially comprising the provision of a generally enclosed drying space and providing in the drying space a well-defined drying zone having a high air flow rate into which the objects which are to be dried are introduced. The drying zone is achieved by blowing in and evacuating, i.e., recirculating the drying air into and from this zone at high speed, and by providing a negative pressure in the drying space with the pressure being least in the drying zone, by evacuating air, having solvent entrained by the recirculation, from the drying zone. This preferably takes place directly and separately from the drying zone and/or in close association with the junction between the drying zone and a contiguous transfer zone in the drying space. The transfer zone is used for introducing and/or removing objects into and from the drying zone, which in a simple way enables maintenance of balanced and adjusted flow conditions in the drying zone. It is, however, also possible to at least partly evacuate solvent-carrying air for leading off from the drying air evacuated for recirculation. However, in this case it may be necessary to evacuate the drying air selectively in a distributed way, so that the necessary balance is maintained.

With the method according to the invention it has been found possible to obtain well defined in the drying zone, controlled air movements suitable for drying so that an extremely good drying effect is obtained simultaneously with a very heavy increase in the content of solvent in the recirculated drying air. The improved drying is obtained without the drying air with entrained solvent spreading into the contiguous transfer zone or zones and to the surroundings. On the contrary, there is obtained as a result of the controlled flow conditions in the drying zone that the necessary, comparatively small amounts of diluting air (corresponding to the recirculated drying air with entrained solvent led off by evacuation for accomplishing negative pressure) are supplied from the contiguous transfer zone or zones, in proportions between the transfer zones which are dependent on the airflow balance in the drying zone provided by separate evacuations. A junction zone or zones constituting reception and/or discharge zones for the objects to be dried can therefore also be simply enclosed, e.g. by means of curtains or the like allowing reception or discharge, without there being risk of solvent leakage to the surroundings.

In the drying zone there thus prevails the greatest negative pressure in combination with high airflow rate, while in the contiguous transfer zone or zones the airflow rate is low and the negative pressure less. It has been found hereby that the uptake of diluting air to the drying zone takes place substantially uniformly over the whole junction surface or surfaces between the drying zone and the contiguous transfer zone or zones, which is of importance for preventing leakage of recirculated solvent-carrying drying air from the drying zone. Surprisingly, it has also been found that by the recirculation of drying air at a great speed, the diluting air intake into the drying zone can be greater than would have been obtained by only evacuating drying air to provide a negative pressure. This is especially advantageous in connection with a preferred embodiment of the invention, as will be described in detail later.

The controlled air flow conditions in the drying zone can be obtained by controlled inblowing of recirculated drying air with regard to the number of blowing-in locations, by the arrangement of these locations, by the alignment of drying air blown in at each location and the amount of drying air blown in at each location, by controlled evacuation of drying air for recirculation with relation to the evacuation locations and evacuated amount at each location, and by controlled evacuation of drying air having solvent entrained by recirculation for providing negative pressure with relation to evacuation locations and evacuated amount.

It will be appreciated that the evacuation for recirculation and removal must, however, take place at at least two locations to enable provision of the balanced airflow conditions according to the invention.

It is to be emphasized that the controlled airflow condition according to the invention enable quicker and more complete drying, especially for objects with uneven surfaces, pockets and the like, so that unevaporated solvent is not contained in the objects when they are removed.

It will be appreciated that the removed drying air having solvent entrained by recirculation can to advantage be taken to an apparatus for recovering the solvent. Since according to the invention the content of solvent in the removed drying air can be very high, a so-called carbon filter can be utilized to advantage for recovery since relatively small amounts of air will have to pass through it. In utilizing a solvent recovery device, a portion of the air passing through it can be returned for blowing in once again, suitably via the recirculation circuit used, whereby further energy gains can be obtained. This must naturally be taken into consideration when balancing the different evacuations from the drying zone.

According to a preferred embodiment of the method according to the invention, the drying space with its drying zone is arranged in association with a processing or treating space in which the objects are treated with solvent so that a substantially totally enclosed space with a transfer zone functioning as a reception zone is obtained between the processing space and drying zone and so that a transfer zone functioning as a discharge zone is obtained between the drying zone and a generally enclosable discharge opening. The objects treated with solvent are taken from the processing space through the reception zone to the drying zone and after drying therein out of the drying space through the discharge zone and discharge opening.

When the processing space contains large amounts of solvent, e.g. in the form of solvent bath, a method of this kind can only be utilized in practice if one can prevent leakage of solvent from the processing space and the transfer zone functioning as reception zone as well as exhaustion of the solvent consequent on too heavy evacuation via the drying zone. This will be possible in conjunction with the present invention thanks to the special flow conditions in the drying zone. According to the invention, due to the recirculation of drying air in the drying zone and well-adjusted evacuation of recirculated drying air therefrom, it is possible to provide for the required amount of diluting air to be small and the major portion of the diluting air to be sucked in through the transfer zone functioning as discharge zone. At the same time, sufficient inflow from the processing space to the drying zone is obtained so that solvent vapor does not have time to diffuse out from the processing space or the reception zone. In this connection it must be emphasized that it has been found, on the absence of recirculation in the drying zone according to the present invention that substantially heavier evacuation of drying air is required (this evacuation being present for creating the required negative pressure in the processing space) to prevent the diffusion of solvent to to the surroundings, but that this also involves rapid exhaustion of the solvent.

According to the invention there is also provided an apparatus for carrying out the above-mentioned method, the apparatus including a generally enclosed drying chamber including a drying zone and at least one contiguous transfer zone intended for introducing and/or of removing objects into and from the drying zone. Means for recirculating drying air in the drying zone by evacuating drying air from the drying zone and blowing in the evacuated drying air at high speed into the drying zone again are also provided along with means for removing air having solvent entrained by the recirculation, by means of evacuating air from the drying zone so that negative pressure is obtained in the drying chamber with the greatest negative pressure in the drying zone. The means for recirculating the drying air suitably comprises one or more blowing-in ducts, preferably arranged at the peripheral portions of the drying zone, having blowing-in openings or jets for directionally blowing in drying air into the drying zone, and one or more evacuation peripheral portions of the drying zone, and fan means connected between the evacuation and blowing-in ducts. The means for removing solvent-carrying drying air suitably include one or more removal ducts with removal openings preferably arranged at the peripheral portions of the drying zone and air extracting fan means connected to the removal ducts. It is also possible to combine the evacuation and removal ducts. The blowing-in openings or jets are preferably arranged substantially symmetrically around the drying zone or with relation to junctions to existing transfer zones. Similarly, the recirculation evacuation opening or openings are preferably arranged mainly symmetrically in the drying zone, so that balanced flow conditions are obtained in the drying zone. A certain amount of displacement of the evacuation openings may be required to accomodate the arrangement of the removal opening or openings. The removal opening or openings are preferably arranged symmetrically taking into account the symmetrical axes of the apparatus, zone division and zone function.

BRIEF DESCRIPTION OF THE DRAWINGS

The invention will now be described in more detail by means of an embodiment example while referring to the attached drawings in which.

DETAILED DESCRIPTION OF THE PREFERRED EMBODIMENTS

Figure 1:
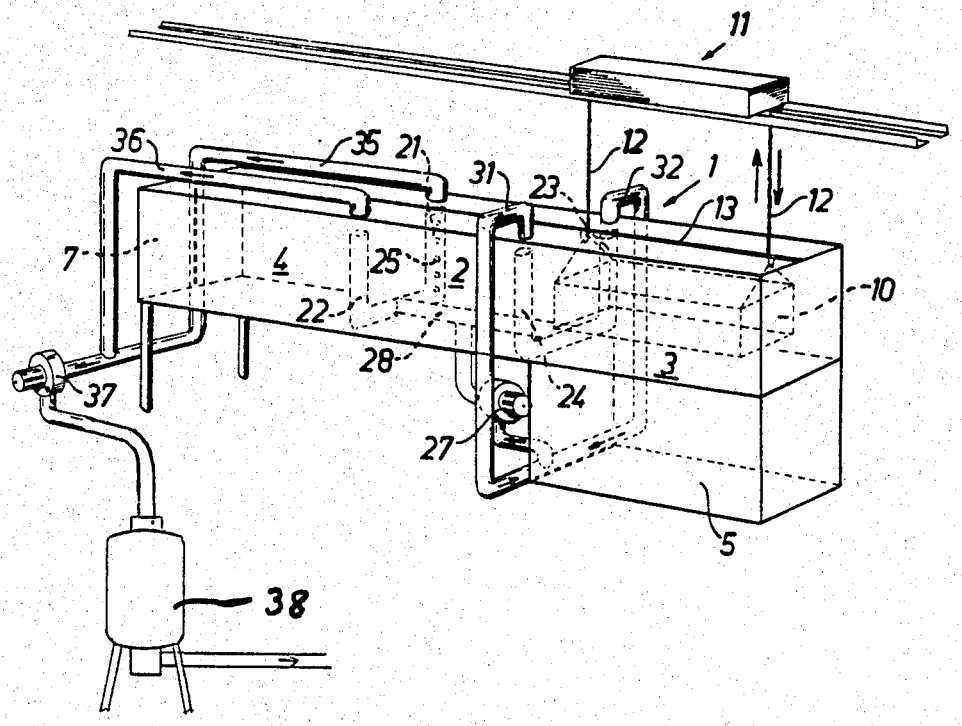
FIG. 1 is a schematic perspective view of an embodiment of an apparatus according to the invention for drying objects degreased by immersion in solvent.
Figure 2:
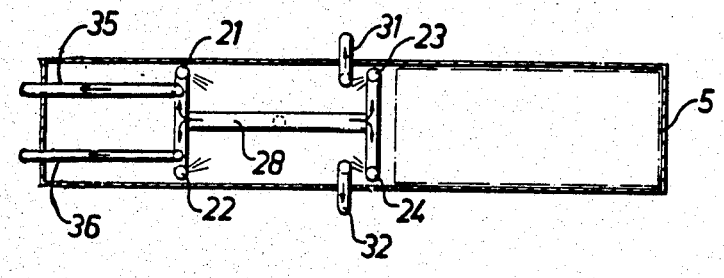
FIG. 2 is a schematic view seen from above, with certain parts of the apparatus according to FIG. 1 removed to illustrate the arrangement of means for blowing air into an evacuation of air from the drying chamber of the apparatus.

The apparatus according to the invention shown in FIGS. 1 and 2 is intended for drying objects which have been treated by solvent by immersion in a solvent bath for the purpose of degreasing. This apparatus comprises a generally parallelepipedic elongate drying chamber 1 which is mainly enclosed and has three zones, namely a drying zone 2 situated in the middle, a first transfer zone 3 intended for introducing solvent-treated objects into the drying zone and a second transfer zone 4 intended for removal of objects from the drying zone. The transfer zones 3 and 4 will be designated reception zone 3 and discharge zone 4 in the following.

The three zones, which thus lie in line with each other and have the same cross section, are not physically separated from each other, the extent of the drying zone 2 being determined by means for blowing drying air into it, as will be described more closely later.

The reception zone 3 is directly connected to a processing space by means of its open bottom, said processing space consisting of the interior of a degreasing tank 5 containing solvent. The connection between the drying chamber 1 and the degreasing tank 5 is at least substantially sealed, so that the drying chamber and the degreasing tank together enclose a substantially enclosed space.

The discharge zone 4 is defined at the end wall of the drying chamber by an easily openable end wall 7, such as a curtain, a slitted apron or the like, which allows an object to pass simply through it. The end wall 7 which, due to the general construction of the apparatus in accordance with the present invention, does not need to be particularly sealed, is preferably made so that it automatically yields for objects passing through it and automatically returns to its normal position thereafter.

The objects which are to be degreased and afterwards dried are placed in a suitable processing box 10 which is arranged to be taken in through the end wall 7 by means of a conveyor 11, through the discharge zone 4 and the drying zone 2 into the reception zone 3 and thereafter immersed in the degreasing tank 5. The conveyor 11 includes suspending ropes 12 for the box 10, these ropes being passed up through a longitudinal slit 13 in the roof of the drying chamber 1, the slit being provided with a longitudinally slotted sealing means not more closely shown.

After the objects in the box 10 have been degreased by the solvent in the degreasing tank 5, the box is lifted up into the reception zone 3, whereafter it is moved into the drying zone 2. When the objects in the box have dried, the conveyor 11 takes the box out of the drying chamber via the discharge zone 4 and the end wall 7.

As has previously been set forth, the extent of the drying zone 2 is determined by the arrangement of the means used for blowing drying air into it. As is apparent from FIGS. 1 and 2, these means comprise four vertical ducts or pipes 21, 22, 23 and 24, which are symmetrically arranged along the side walls of the drying chamber 1 so that the drying zone 2 thereby defined will be rectangular as seen in a horizontal section or from above (compare with FIG. 2). In other words, the pipes 21–24 are arranged in the corners of the drying zone 2. Each of the pipes is provided with openings 25 on a side facing in towards the drying zone 2, through which drying air is blown into the drying zone. The openings 25 are so arranged that the drying air is blown substantially towards the middle of the drying zone, as is indicated in FIG. 2, which results in heavy turbulence being obtained in the middle of the drying zone. It will be appreciated that the opening 25, which are suitably circular, do not need to be situated along one and the same vertical line, but can be distributed to give the desired blowing-in pattern, keeping in mind the best drying conditions and the achievement of balanced flow conditions in the entire drying zone.

The ducts or pipes 21–24 are fed with drying air from an outside recirculating fan 27 via distribution ducts 28, which are arranged at the bottom of the drying chamber in the drying zone. The fan 27 extracts or sucks drying air from the drying zone for recircultation with the help of ducts 31, 32, opening out into the drying chamber roof above the drying zone. The evacuation or suction openings of the ducts 31, 32 in the drying zone are symmetrically situated opposite each other on either side of the longitudinal axis of the drying chamber to give balanced evacuation. The evacuation openings of the ducts 31, 32 are, however, displaced from the middle of the drying zone 2 in a direction towards the junction between the drying zone 2 and the reception zone 3, due to the effect of the evacuation of recirculated drying air described below.

For evacuating drying air having solvent entrained by recirculation, there are two ducts 35, 36 connected to a suction fan 37 feeding a carbon filter 38 and to the drying chamber at the junction between the discharge zone 4 and the drying zone 2. The evacuation or suction openings of the ducts 35, 36 are arranged in the roof of the drying chamber opposite each other, substantially between the blowing-in ducts 21 and 22, and symmetrical on either side of the longitudinal axis of the drying chamber to give balanced extraction.

With the apparatus according to FIGS. 1 and 2 it has been found possible to achieve a very unified and defined drying zone, in which extremely effective drying can be achieved due to extremely heavy turbulence. Furthermore, the maintenance of the well-adjusted and balanced air flow conditions (with regard to blowing-in and evacuation) means that in the junctions between the drying zone 2 and the reception zone 3 and the discharge zone 4 there is still obtaine a substantially uniform effective evacuation or suction effect over the whole of the junctions, which completely eliminates leakage of solvent vapor to the surroundings. Through the balanced evacuation from the drying zone with relation to recirculation and removal to a carbon filter it will be possible effectively to keep down the consumption of diluting air simultaneously as the major portion of the diluting air can be sucked in via the discharge zone and only a small part needs to be sucked in via the reception zone 3. In the latter it is thus surprisingly possible to maintain low air flow rate and small negative pressure, which is of great importance for preventing exhaustion of the solvent supply in the tank 5, and consequently to prevent solvent vapors diffusing out to the surroundings.

As an example of the function of an apparatus with a construction according to FIG. 1 the following typical measured values can be accounted for:

Volume of drying zone: $\sim 1\ m^3$
volume of reception zone: $\sim 1\ m^3$
volume of discharge zone: $\sim \frac{3}{4}\ m^3$
recirculated quantity of air: $\sim 1200\ m^3/h$
removed quantity of air: $\sim 300\ m^3/h$
negative pressure in drying zone: $\sim 1.4$ mm water column
negative pressure in the reception zone: $\sim 1.2$ mm water pressure
negative pressure in the discharge zone: $\sim 1.3$ mm water pressure It will be apparent herefrom that the recirculation of drying air, in combination with balanced extraction from the drying zone according to the invention, enables maintenance of separate pressures in the transfer zones for preventing exhaustion of a solvent supply as well as outward diffusion of solvent vapors in an advantageous manner as has been described above.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A method of drying solvent-treated objects, the method comprising introducing the objects to be dried into a generally enclosed drying space, circulating drying air in the drying space for entraining solvent from the solvent-treated objects, removing air having solvent entrained therein after circulating, providing in the drying space a well-defined drying zone into which the objects to be dried are introduced, establishing a high air flow rate in the drying zone by circulating the drying air at high speed by blowing-in and evacuating drying air, establishing negative pressure in the drying space with greatest negative pressure in the drying zone by withdrawing air having solvent entrained from circulation from the drying zone closely adjacent to a junction between the drying zone and a contiguous transfer zone adapted for introducing and removing objects from the drying zone within the drying space.

2. The method as in claim 1, wherein the drying space including the drying zone is arranged connected with a processing space in which the objects are treated with solvent such that a substantially enclosed total space results, a first transfer zone functioning as a reception zone between the processing space and the drying zone, a second transfer zone functioning as a discharge zone between the drying zone and a substantially enclosable discharge opening, and further comprising transporting said solvent-treated objects from the processing space through the reception zone to the drying zone and after drying therein transporting said objects out of the drying space through the discharge zone and the discharge opening.

3. A method as in claim 1, further comprising withdrawing the air having solvent entrained from circulation in a symmetrical and balanced manner in relation to the contiguous junction to the transfer zone so that substantially uniform flow conditions are obtained at the junction.

4. The method as in claim 1, wherein the circulating drying air flows directionally into the drying zone from peripheral portions of the drying zone.

5. The method as in claim 4, further comprising flowing the circulating drying air into the drying zone at the junction with the transfer zone and directing the air substantially away from the transfer zone.

6. The method as in claim 1, further comprising flowing the circulating drying air into the drying zone substantially symmetrically around the drying zone.

7. The method as as in claim 1, further comprising flowing the circulating drying air into the drying zone mainly towards the middle of the drying zone for providing heavy turbulence.

8. The method as in claim 1, further comprising flowing the circulating drying air into the drying zone substantially as a curtain on at least two opposing sides of the drying zone.

9. The method as in claim 8, wherein the two opposing sides are contiguous to a respective transfer zone.

10. The method as in claim 8, further comprising flowing the circulating drying air into the drying zone as a circumferential curtain.

11. The method as in claim 8, further comprising evacuating the circulating drying air from the drying zone for recirculation so that the inflowing curtain of air flows backwards in the drying zone in a direction opposite to the curtain flow.

12. The method as in claim 11, further comprising evacuating the drying air from the drying zone for recirculation substantially symmetrically and balanced with regard to the blowing-in of drying air and the withdrawing of solvent-carrying air.

13. The method as in claim 1, further comprising withdrawing the solvent-carrying air such that a major portion of diluting air sucked into the drying space flows into a transfer zone functioning as a discharge zone.

14. The method as in claim 11, further comprising flowing the withdrawn solvent-containing air through a solvent recovery device, and recirculating a portion of the air which has passed through the solvent recovery device for blowing into the drying zone together with the recirculated drying air.

15. An apparatus for drying solvent-treated objects, comprising a generally enclosed drying chamber arranged to receive solvent-treated objects to be dried, means for circulating drying air in the drying chamber for entraining solvent from the objects introduced therein, means for removing air having solvent entrained from circulation, the drying chamber including a drying zone and at least one contiguous transfer zone within the chamber in substantially free communication with the drying zone for introducing and removing objects from the drying zone, said means for circulating the drying air being arranged to evacuate drying air from the drying zone and to blow in the drying air at high speed directly into the drying zone, said means for removing air having solvent entrained therein being arranged to withdraw air from the drying zone closely adjacent to a junction between the at least one contiguous transfer zone and the drying zone whereby slight negative pressure is obtained in the drying chamber with greatest negative pressure in the drying zone.

16. The apparatus as in claim 15, wherein the drying chamber includes a first transfer zone functioning as a reception zone, said first transfer zone being connected to a processing space in which objects are treated with solvent, and a second transfer zone functioning as a discharge zone having a substantially closeable discharge opening.

17. The apparatus as in claim 16, further comprising transporting means for transporting objects to be treated from the processing spaced through the reception zone to the drying zone and thereafter out through the discharge zone and the discharge opening.

18. The apparatus as in claim 17, wherein said transporting means is also arranged for transporting objects for treatment to the processing space through the discharge zone, the drying zone and the reception zone.

19. The apparatus as in claim 15, wherein said means for circulating the drying air comprise at least one evacuating duct with evacuating openings situated in the drying zone for evacuating drying air, at least one blowing-in duct with blowing-in openings situated in the drying zone for blowing-in drying air, and first fan means connected between the at least one evacuating duct and the at least one blowing-in duct.

20. The apparatus as in claim 19, wherein the blowing-in openings are arranged at peripheral portions of the drying zone for directing drying air into the drying zone.

21. The apparatus as in claim 20, wherein the blowing-in openings are arranged at the junction between the at least one transfer zone and the drying zone in an edge area of the drying zone.

22. The apparatus as in claim 20, wherein the blowing-in ducts comprise duct portions having blowing-in openings and extending along the peripheral portions of the drying zone.

23. The apparatus as in claim 20, wherein the evacuating openings are arranged in the peripheral portions of the drying zone, substantially symmetrical in relation to the blowing-in openings and said means for removing solvent-containing air.

24. The apparatus as in claim 23, wherein said means for removing solvent-containing air comprise at least one removal duct with removal openings situated in the drying zone or in close association with the drying zone and an air evacuation fan connected to the at least one removal duct.

25. The apparatus as in claim 24, wherein the removal openings are arranged at a junction in a transfer zone functioning as a discharge zone.

26. The apparatus as in claim 24, wherein the evacuation openings are arranged displaced in a direction away from the removal openings for providing balanced flow conditions in the drying zone.

* * * * *